US009731518B2

(12) United States Patent
Luedeman et al.

(10) Patent No.: US 9,731,518 B2
(45) Date of Patent: Aug. 15, 2017

(54) PRINT MEDIA GUIDE

(76) Inventors: Timothy Jacob Luedeman, Portland, OR (US); Kevin Lo, Vancouver, WA (US); Wesley R Schalk, Camas, WA (US)

( * ) Notice: Subject to any disclaimer, the term of this patent is extended or adjusted under 35 U.S.C. 154(b) by 31 days.

(21) Appl. No.: 14/391,468

(22) PCT Filed: Apr. 10, 2012

(86) PCT No.: PCT/US2012/032884

§ 371 (c)(1),
(2), (4) Date: Oct. 9, 2014

(87) PCT Pub. No.: WO2013/154538

PCT Pub. Date: Oct. 17, 2013

(65) Prior Publication Data

US 2015/0231898 A1 Aug. 20, 2015

(51) Int. Cl.
*B41J 11/00* (2006.01)

(52) U.S. Cl.
CPC ..... *B41J 11/0045* (2013.01); *B41J 11/0005* (2013.01)

(58) Field of Classification Search
CPC ..... B41J 2/01; B41J 13/0036; B41J 13/106; B41J 13/16
See application file for complete search history.

(56) References Cited

U.S. PATENT DOCUMENTS

| | | | |
|---|---|---|---|
| 5,108,205 | A | 4/1992 | Stone |
| 5,564,847 | A | 10/1996 | Patrick et al. |
| 5,883,655 | A | 3/1999 | Szlucha |
| 6,257,570 | B1 | 7/2001 | Ficyk |
| 6,390,468 | B1 | 5/2002 | Michel et al. |
| 6,682,190 | B2 | 1/2004 | Rasmussen et al. |
| 7,104,537 | B2 | 9/2006 | Trovinger et al. |
| 2007/0003355 | A1 | 1/2007 | Connors et al. |
| 2008/0237976 | A1 | 10/2008 | Murrell et al. |
| 2012/0019593 | A1 | 1/2012 | Scheffelin et al. |

FOREIGN PATENT DOCUMENTS

| | | | |
|---|---|---|---|
| CN | 1463226 | | 12/2003 |
| CN | 1517228 | | 8/2004 |
| CN | 1939727 | | 4/2007 |
| CN | 101574866 | | 11/2009 |
| JP | 01168182 | | 6/1989 |
| JP | 2011194676 | A * | 10/2011 |

OTHER PUBLICATIONS

International Search Authority, International Search Report, Mail date Aug. 13, 2013, Application No. PCT/US2013/032884 Filing date Apr. 10, 2012.

* cited by examiner

*Primary Examiner* — Kristal Feggins
*Assistant Examiner* — Kendrick Liu
(74) *Attorney, Agent, or Firm* — HP Inc. Patent Department

(57) ABSTRACT

In one example, a media guide for use in a printer having a print bar and a print zone adjacent to the print bar includes a movable blocker downstream from the print zone along a media path and movable though a range of motion to block print media from leaving the media path when exiting the print zone.

11 Claims, 9 Drawing Sheets

PRINT MEDIA GUIDE

BACKGROUND

In some inkjet printers, a media wide printhead assembly, commonly called a print bar, is used to print on paper or other print media moving past the print bar. Media wide printers usually can print faster than printers in which a narrower printhead assembly is scanned back and forth across the print media.

DRAWINGS

The same part numbers designate the same or similar parts throughout the figures.

DESCRIPTION

Faster printing, media wide printers allow the ink little lime to dry before leaving the print zone. Wet ink can cause the leading edge of the print media to curl and cockle as it exits the print zone. A curled or cockled leading edge may curl into any gap between the print fear and downstream parts, causing the media to jam. A new media guide has been developed to block the gap behind the print bar immediately downstream from the print zone so that the print media will not curl into this gap and jam. In one example, the media guide includes a blocker that is biased against the print bar through a range of motion that covers the range of motion of the print bar for changing the spacing between the print bar and the media support platen, such as for thicker (or thinner) media and for duplex printing. Accordingly, examples of the new media guide are described with reference to an inkjet printer using a media wide print bar. However, examples of the new media guide are not limited to media wide print bars or even inkjet printers. Examples of the new media guide might also be implemented in other inkjet type dispensers. The examples shown in the figures and described below, therefore, illustrate but do not limit the invention, which is defined in the Claims following this Description.

As used in this document, "liquid" means a fluid not composed primarily of a gas or gases; a "platen" means a supporting structure or multiple supporting structures and is not limited to a flat plate; a "printhead" means that part of an inkjet printer or other inkjet type dispenser that dispenses liquid from one or more openings, for example as drops or streams; a "print bar" means a structure or device holding an arrangement of one or more printheads that remains stationary during printing. "Printhead" and "print bar" are not limited to printing with ink but also include inkjet type dispensing of other liquids and/or for uses other than printing.

Figure 1:
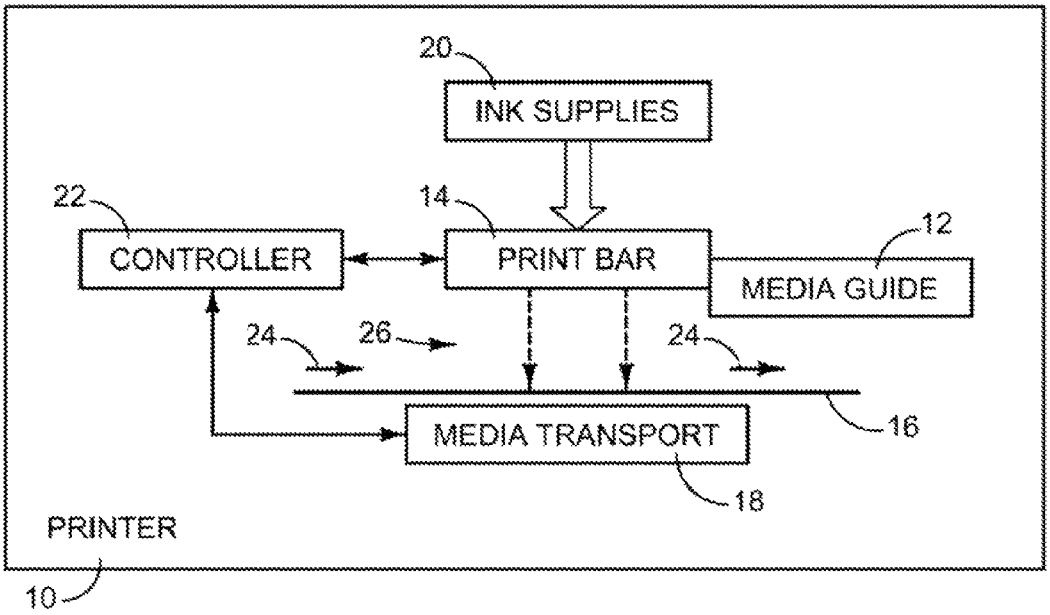
FIG. 1 is a block diagram illustrating an inkjet printer in which examples of a new print media guide may be implemented.

FIG. 1 is a block diagram illustrating an inkjet printer 10 in which examples of a new print media guide 12 may be implemented. Referring to FIG. 1, printer 10 includes a print bar 14 that includes an arrangement of one or more printheads for dispensing ink on to a sheet or continuous web of paper or other print media 16. Printer 10 also includes a print media transport mechanism 18 for moving media 16, an ink supply or multiple supplies 20 for supplying ink to print bar 14, and a printer controller 22. Controller 22 represents generally the programming, processor(s) and associated memories, and the electronic circuitry and components needed to control the operative elements of printer 10. Print media guide 12 is located immediately downstream from print bar 14 along a media path 24 that proceeds from left to right in FIG. 1, as indicated by media path arrows 24. As described in more detail below with reference to the examples shown in FIGS. 2-11, media guide 12 blocks the gap behind print bar 14 immediately downstream from print zone 26 so that the leading edge of media 16 will not curl into or otherwise jam at this gap.

Figure 2:
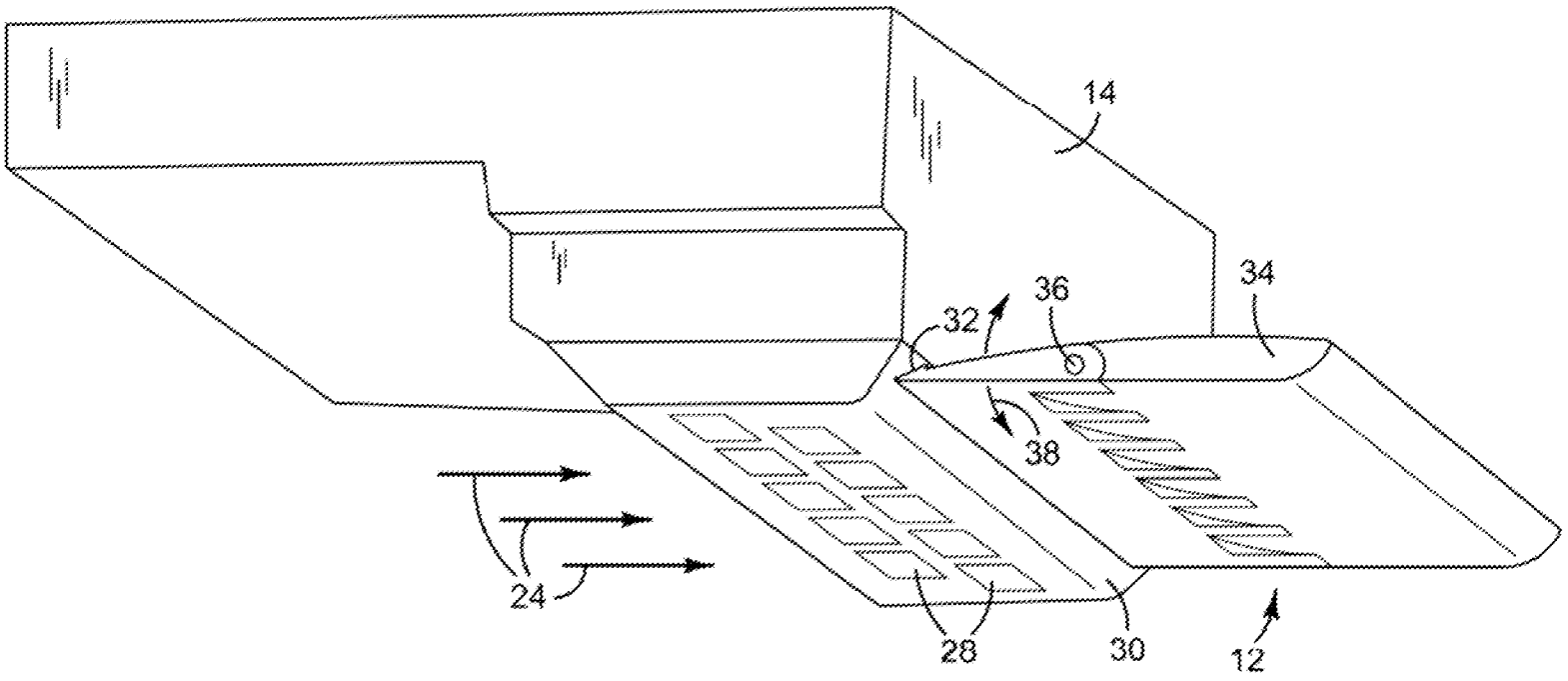
FIG. 2 is a perspective view illustrating one example of a new media guide configured to block the gap behind the print bar, such as might be used in the printer of FIG. 1.
Figure 3:
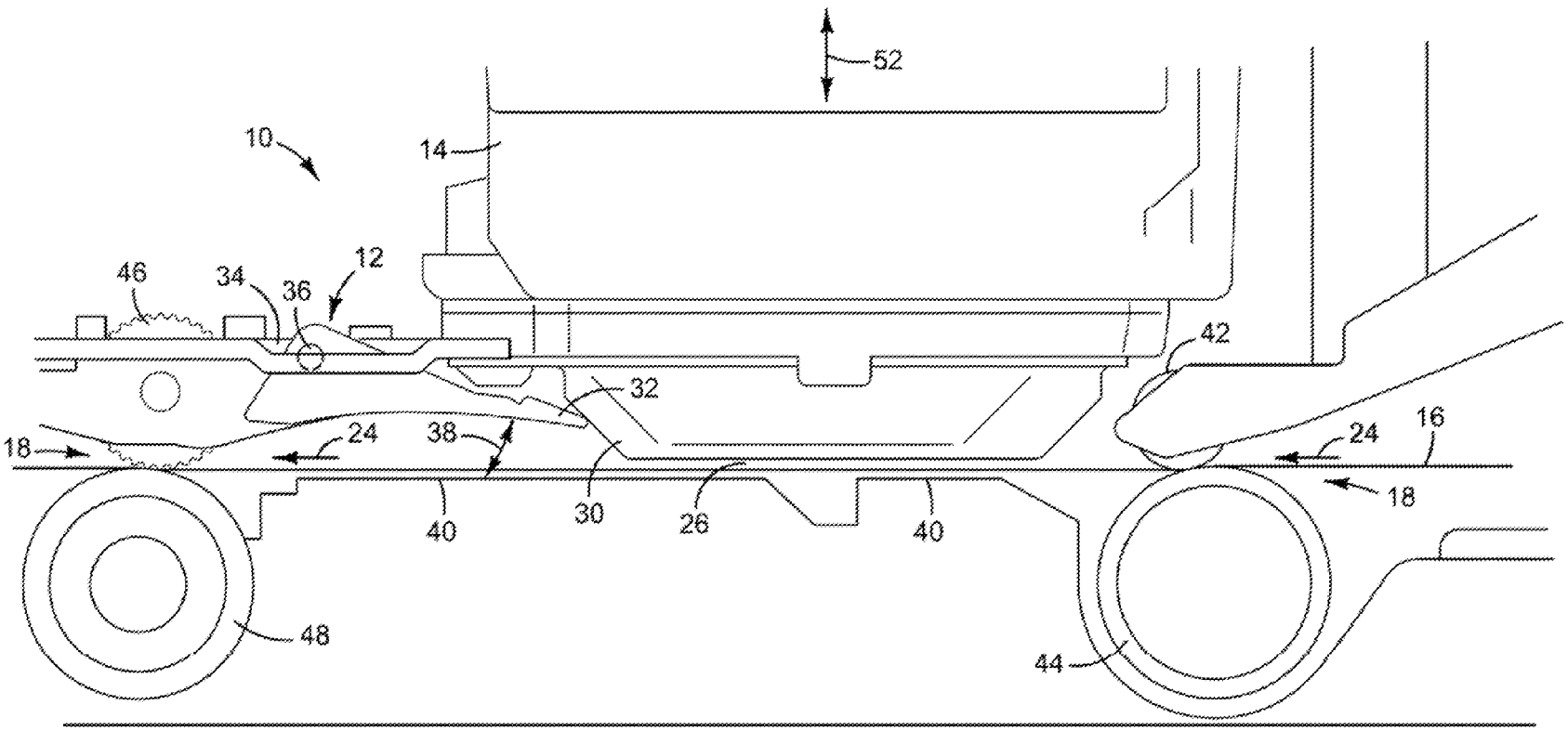
FIGS. 3 and 4 are side elevation and top down perspective views, respectively, illustrating the print zone in an inkjet printer implementing one example of the new print media guide. The print bar is omitted in FIG. 4 to better illustrate the media guide.
Figure 4:
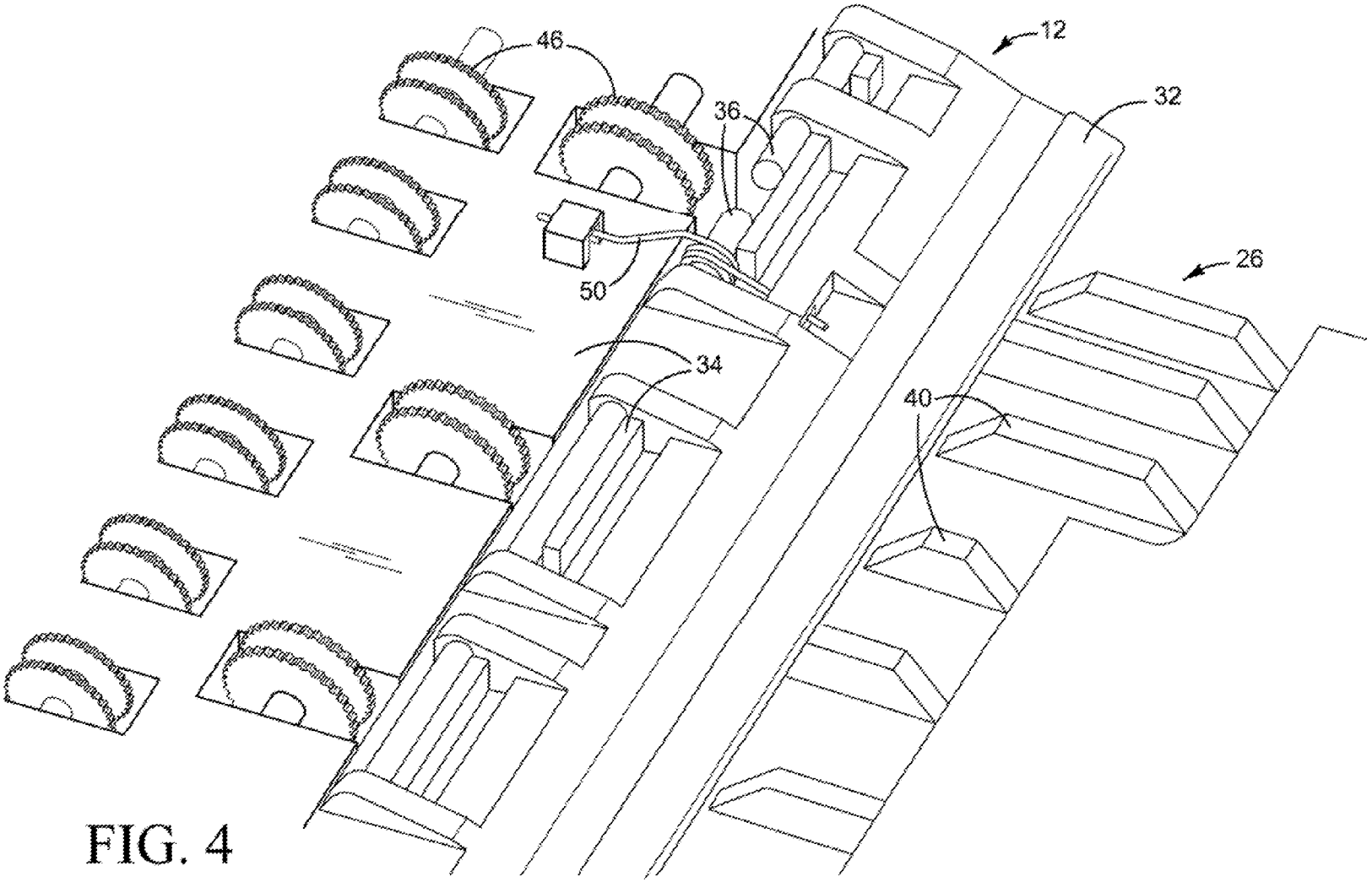

FIG. 2 is a perspective view illustrating one example of a new media guide 12 configured to block the gap behind print bar 14, such as might be used in the printer of FIG. 1. FIGS. 3 and 4 are more detailed views illustrating a print zone 26 in an inkjet printer 10 implementing a media guide 12 like the one shown in FIG. 2.

Referring first to FIG. 2, a media wide print bar 14 includes multiple printheads 28 surrounded by a shroud or other protective structure 30. Media guide 12 includes a moveable blocker 32 connected to a stationary base 34. The media path is from left to right in FIG. 2 as indicated by arrows 24. Blocker 32 is positioned immediately downstream from print bar 14 and extends across substantially the full width of media path 24 to block print media from the space behind print bar 14. In this example for guide 12, blocker 32 pivots on base 34 along a pivot 36, as indicated by motion arrow 38. The pivotable blocker 32 is biased against print bar 14 shroud 30 through a range of motion that covers the range of motion of print bar 14 for changing the printhead to platen spacing, such as for thicker (or thinner) media and for duplex printing. Although a single continuous blocker 32 spans the media path in FIG. 2, other configurations are possible. For example, multiple discrete blockers spaced apart from one another might be used in some implementations as long as there is sufficient blocking area to effectively block the print media from jamming behind print bar 14.

Referring now to the more detailed views of FIGS. 3 and 4, print bar 14 positioned over a media support platen 40 defines a print zone 26 in which ink is dispensed on to the paper or other print media 16. Print bar 14 and media 16 are omitted from the top down perspective view of FIG. 4 to better illustrate media guide 12. As best seen in FIG. 3, media transport 18 includes print zone entry rollers 42, 44 and exit rollers 46, 48. In this example, exit rollers 46 are configured as star wheels 46 that help minimize damaging the ink image on media 16 as it exits print zone 26.

In this example for guide 12, blocker 32 is connected to base 34 at pivot 36. A torsion spring or other suitable biasing mechanism 50 (FIG. 4) biases the pivotable blocker 32 through a range of motion that covers the range of motion of print bar 14 for changing the spacing between printheads 28 (FIG. 2) and platen 40, for example to accommodate different thicknesses of print media 16. In this example, as shown in FIG. 4, spring 50 is connected between a stationary base 34 and blocker 32. Other suitable biasing configurations are possible. The rotational motion of blocker 32 is indicated by arrow 38 in FIG. 3 and the translational motion of print bar 14 is indicated by arrow 52 in FIG. 3. In the example shown in the figures, blocker 32 is biased against print bar 14, in particular against shroud 30. While it is expected that blocker 32 will usually be biased against print bar 14 to eliminate any gap behind print bar 14, it may be adequate or even desirable in some implementations that blocker 32 not contact print bar 14.

Figure 5:
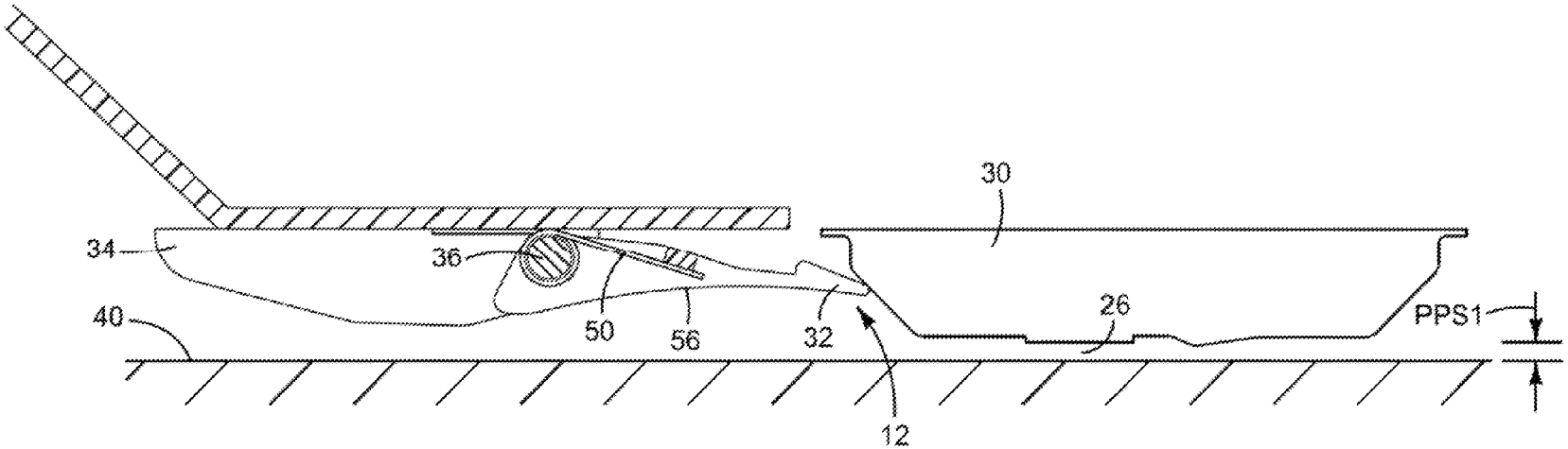
FIGS. 5 and 6 illustrate alternate printing positions for the print bar and media guide shown in FIGS. 3 and 4.
Figure 6:
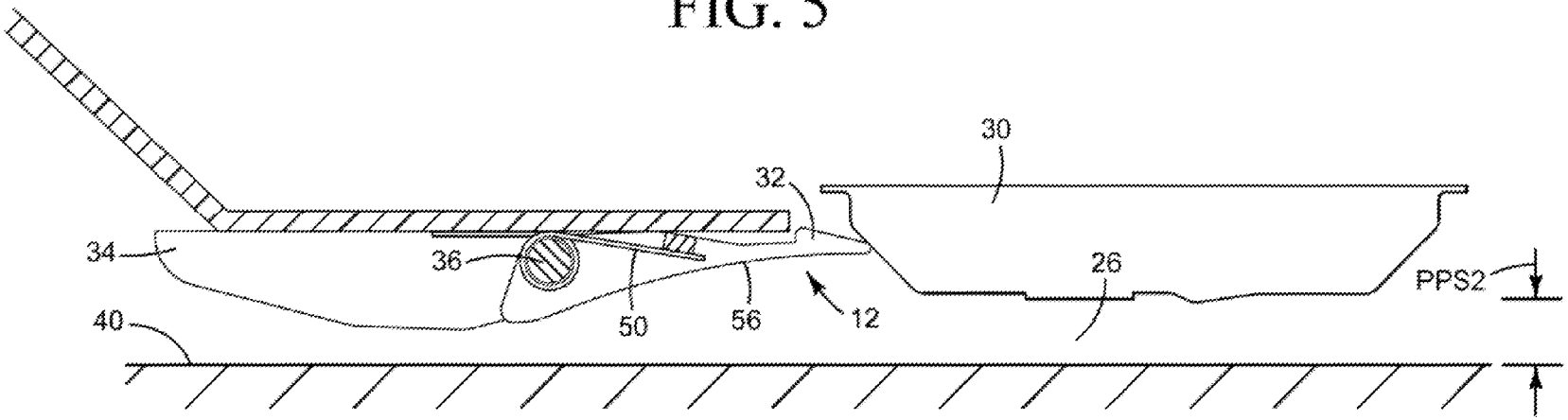
Figure 7:
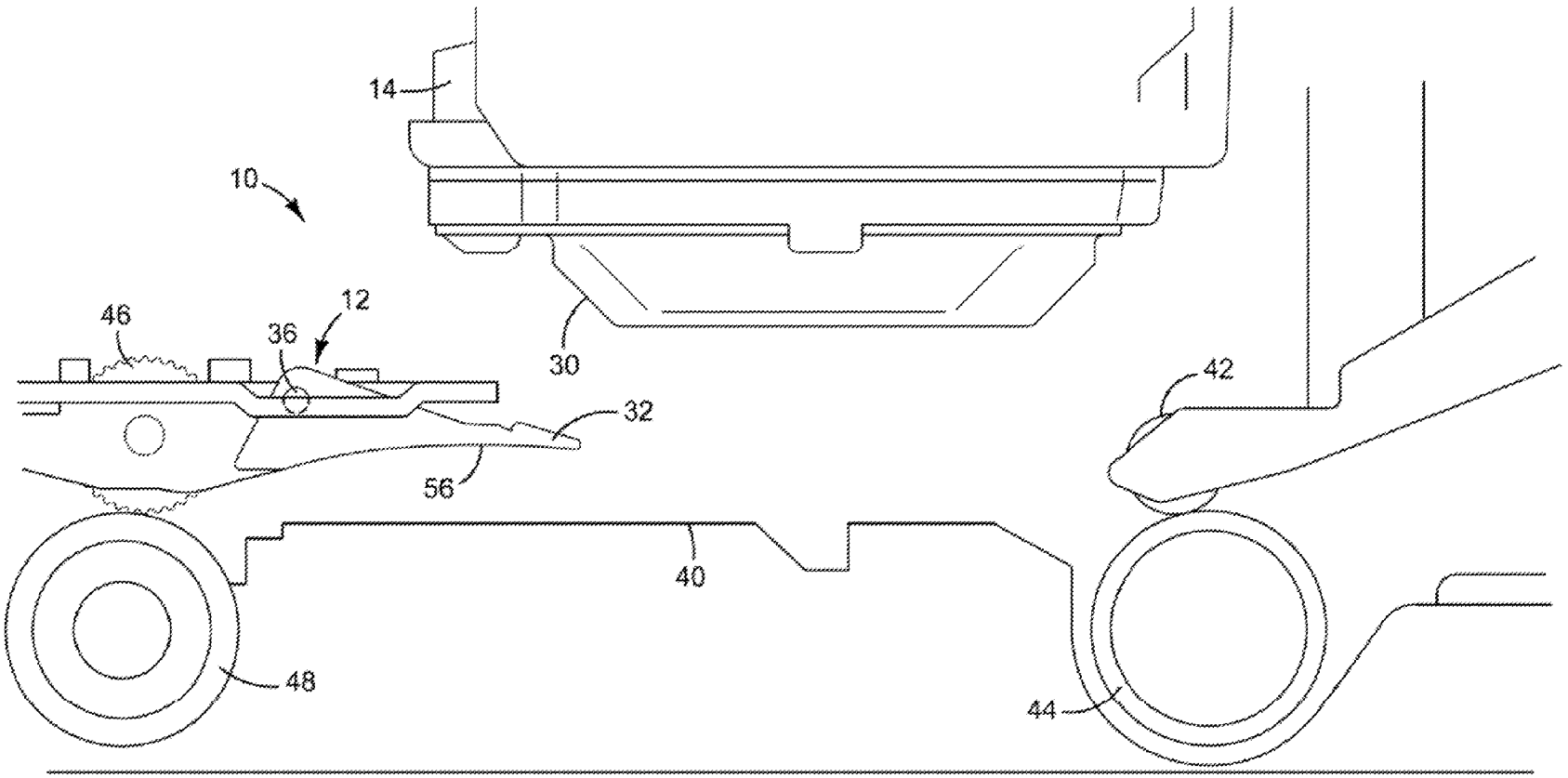
FIG. 7 illustrates the media guide shown in FIGS. 3 and 4 with the print bar in a service position.

FIGS. 5 and 6 show different printhead to platen spacing for printing and the corresponding positions for print bar 14 and media guide 12. FIG. 7 shows print bar 14 in a servicing position raised far above platen 40 and the corresponding position of media guide 12. In FIG. 5, print bar 14 is lowered to a smaller printhead to platen spacing PPS1 and spring 50 presses blocker 32 against print bar shroud 30. In FIG. 6, print bar 14 is raised to a larger printhead to platen spacing PPS2, blocker 32 has rotated up at the urging of spring 50, and spring 50 continues to press blocker 32 against print bar shroud 30. In FIG. 7, print bar 14 is raised to a service position too far above platen 40 for printing and outside the range of motion of blocker 32. Thus, blocker 32 no longer contacts print bar shroud 30, for example either because the further rotation of blocker 32 is blocked or because spring 50 no longer exerts a biasing force on blocker 32.

Figure 8:
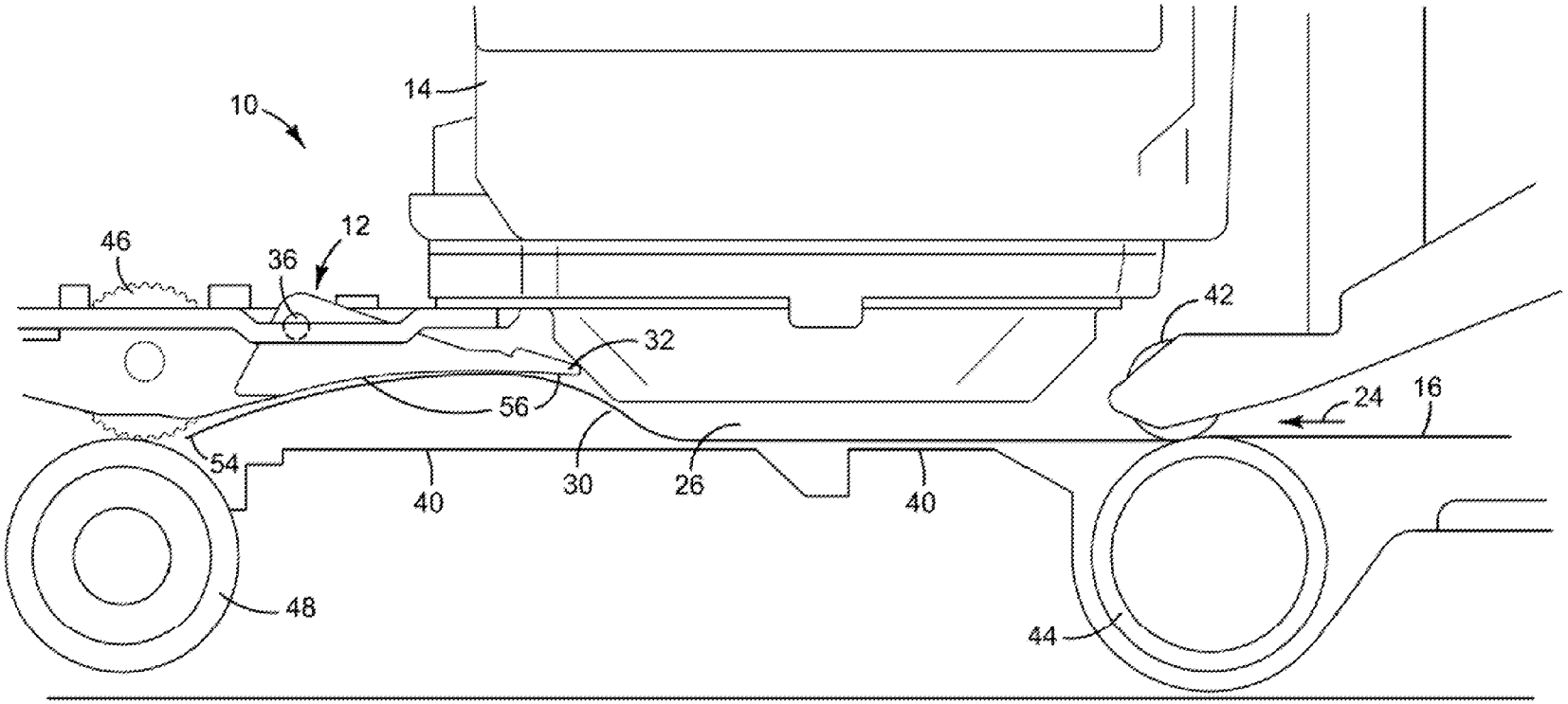
FIG. 8 illustrates the media guide of FIGS. 3 and 4 blocking the leading edge of a sheet of print media exiting the print zone from leaving the media path.

FIG. 8 illustrates media guide 12 blocking the leading edge 54 of a sheet of print media 16 exiting print zone 26. Print bar 14 in FIG. 8 is in the PPS2 position of FIG. 6 such as might be used for duplex printing or printing thicker media 16. Referring to FIG. 8, blocker 32 includes a surface 56 that blocks media leading edge 54 from leaving media path 24 downstream from print zone 26 and guides leading edge 54 toward the nip between star wheel 46 and exit roller 48.

Figure 9:
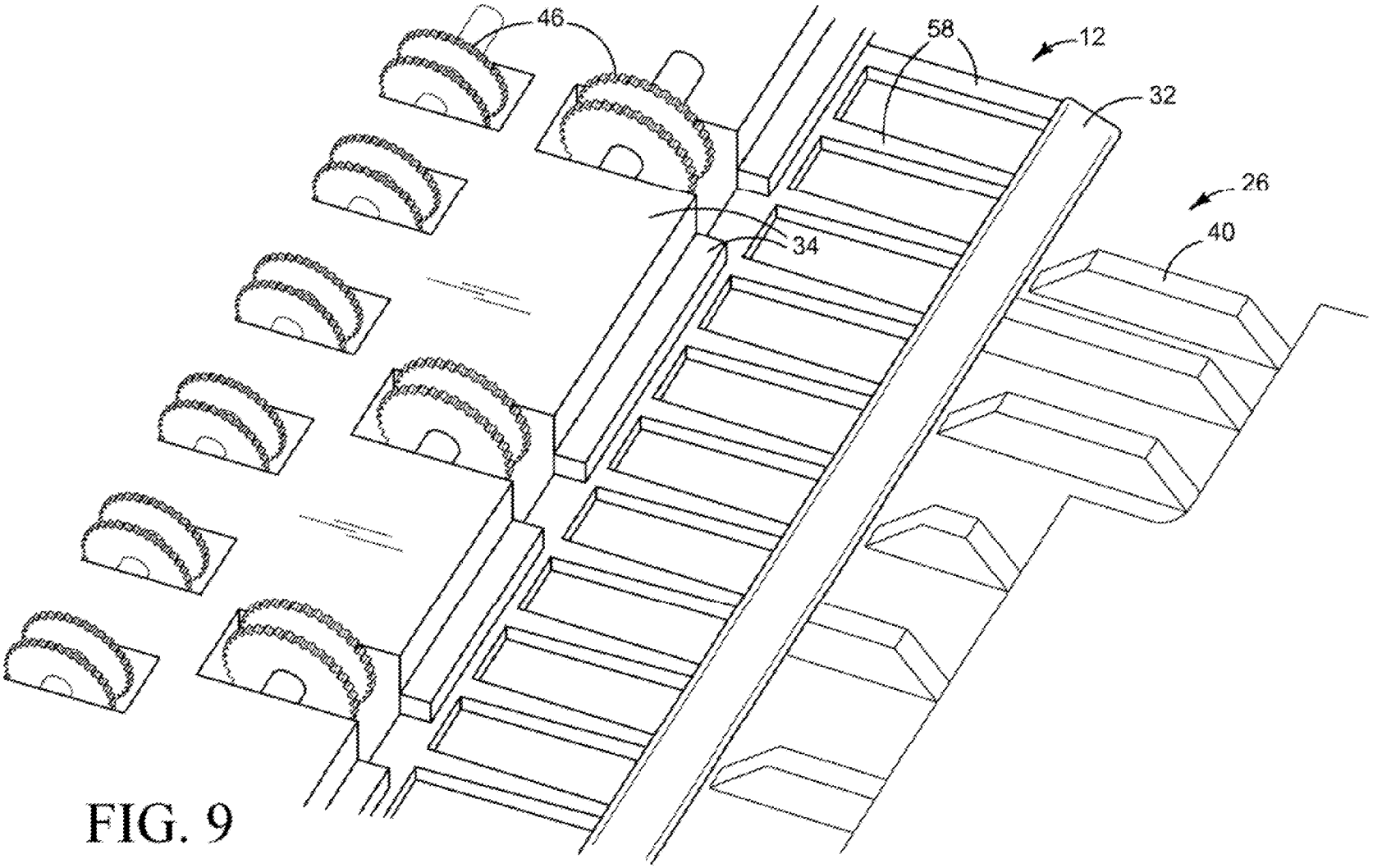
FIG. 9 is a top down perspective view illustrating another example of the new media guide.
Figure 10:
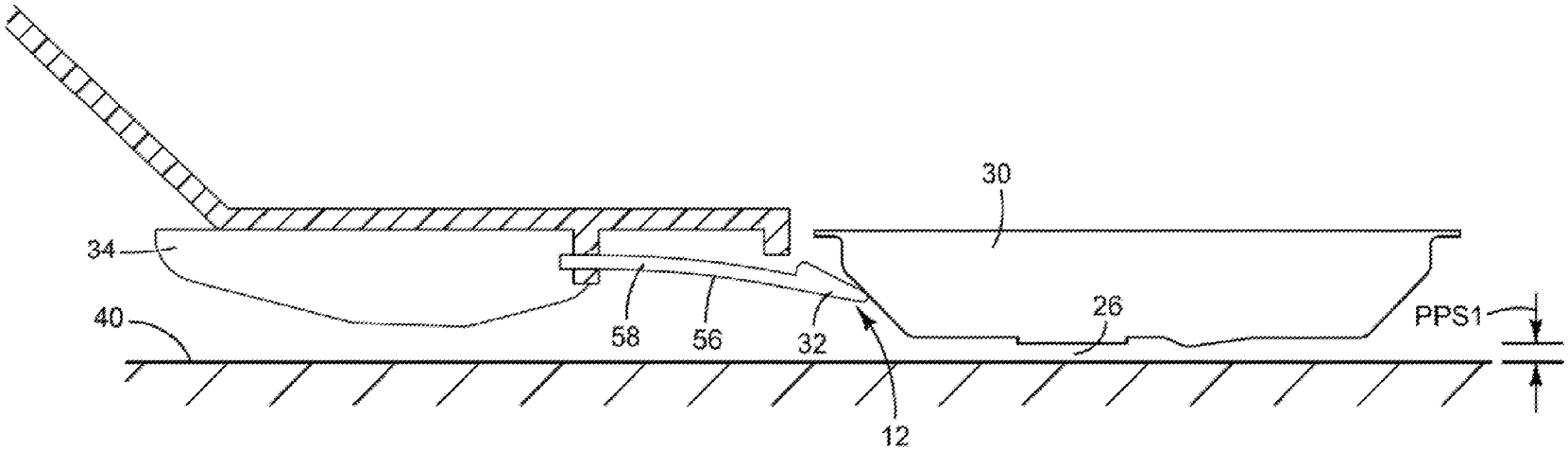
FIGS. 10 and 11 illustrate alternate positions for the media guide shown in FIG. 9.
Figure 11:
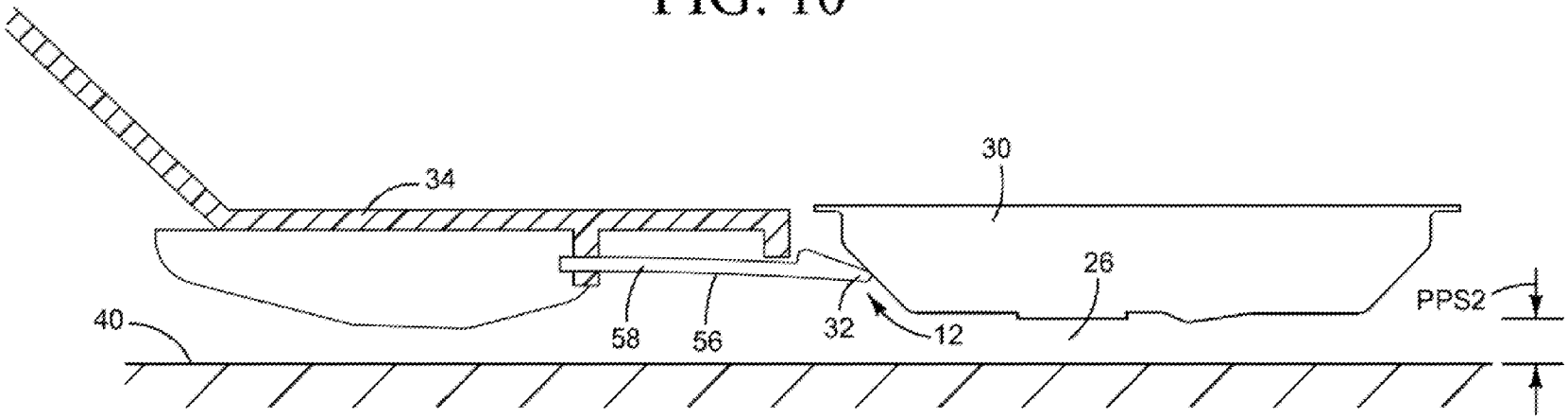

FIG. 9 illustrates another example of the new media guide 12 in which guide 12 includes a built-in biasing mechanism. FIGS. 10 and 11 show different printhead to platen spacing for printing and the corresponding positions for print bar 14 and for this example of media guide 12. Referring to FIGS. 9-11, blocker 32 is connected to base 34 through flexible connectors 58. When flexed, as shown in FIGS. 10 and 11, each connector 58 acts as a biasing mechanism that urges blocker 32 against print bar shroud 30. Blocker 32 and connectors 58 together form guide surface 56 that blocks the leading edge of the print media from leaving media path 24 downstream from print zone 26 and guides the leading edge toward the nip between star wheel 46 and exit roller 48 (FIG. 8).

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A media guide for use in a printer having a print bar and a print zone adjacent to the print bar, the media guide comprising a movable blocker downstream from the print zone along a media path and movable through a range of motion to block print media from leaving the media path when exiting the print zone, wherein the blocker comprises a first end that is biased upwards against the print bar through the range of motion, the first end being opposite from a pivot end of the blocker, and the blocker range of motion covers a range of motion of the print bar.

2. The media guide of claim 1, wherein the blocker is biased against the print bar through the range of motion and the blocker range of motion covers a range of motion of the print bar for changing a printhead to platen spacing.

3. The media guide of claim 1, further comprising:

a stationary base, the blocker pivotably connected to the base so that the blocker is movable through the range of motion along an arc to block print media exiting the print zone from leaving the media path; and a biasing mechanism operatively connected between the base and the blocker to bias the blocker through the range of motion.

4. The media guide of claim 3, wherein the biasing mechanism comprises a spring operatively connected between the blocker and the base.

5. The media guide of claim 3, wherein the biasing mechanism comprises a flexible connector connecting the blocker to the base.

6. The media guide of claim 1, wherein the blocker includes a smooth guide surface to guide a leading edge of print media exiting the print zone along the media path.

7. A printer, comprising:

a print bar including a printhead;

a platen for supporting print media along a media path through a print zone near the print bar; and a print media guide configured to block print media from leaving the media path immediately downstream from the print bar, wherein the media guide includes a movable blocker downstream from the print zone along the media path, wherein the blocker comprises a first end that is biased upwards against the print bar through a range of motion covering a range of motion of the print bar, the first end of the blocker being opposite from a pivot end of the blocker.

8. The printer of claim 7, wherein the blocker is biased against the print bar and the range of motion covers a range of motion of the print bar for changing a printhead to platen spacing.

9. The printer of claim 8, wherein the media guide also includes:

a stationary base, the blocker pivotably connected to the base so that the blocker is movable through the range of motion along an arc to block print media exiting the print zone from leaving the media path; and a biasing mechanism operatively connected between the base and the blocker to bias the blocker against the print bar through the range of motion.

10. The printer claim 9, wherein the blocker includes a smooth guide surface to guide a leading edge of print media exiting the print zone along the media path.

11. A print media guide for use in a printer having a print bar that includes a printhead and a print zone between the printhead and a print media support platen, the media guide comprising a movable surface downstream from the printhead along the print zone and biased upwards against the print bar to guide print media toward a desired media path when exiting the print zone, the movable surface being disposed on a first end of the blocker that is opposite from a pivot end of the blocker.

* * * * *